US008240389B2

(12) United States Patent
Christie

(10) Patent No.: US 8,240,389 B2
(45) Date of Patent: Aug. 14, 2012

(54) COMBINED TREE STAB AND CONTROL INTERFACE

(75) Inventor: David S. Christie, Aberdeen (GB)

(73) Assignee: Vetco Gray Inc., Houston, TX (US)

( * ) Notice: Subject to any disclaimer, the term of this patent is extended or adjusted under 35 U.S.C. 154(b) by 399 days.

(21) Appl. No.: 12/562,813

(22) Filed: Sep. 18, 2009

(65) Prior Publication Data

US 2010/0078176 A1 Apr. 1, 2010

Related U.S. Application Data

(60) Provisional application No. 61/100,549, filed on Sep. 26, 2008.

(51) Int. Cl.
*E21B 33/035* (2006.01)

(52) U.S. Cl. ..... 166/368; 166/378

(58) Field of Classification Search ..... 166/348, 166/350, 351, 368
See application file for complete search history.

(56) References Cited

U.S. PATENT DOCUMENTS

| | | | | |
|---|---|---|---|---|
| 4,333,526 | A | 6/1982 | Watkins | |
| 5,465,794 | A | 11/1995 | McConaughy et al. | |
| 5,555,935 | A | 9/1996 | Brammer et al. | |
| 5,865,250 | A | 2/1999 | Gariepy | |
| 5,926,220 | A | 7/1999 | Linzer | |
| 6,244,348 | B1 | 6/2001 | Gariepy et al. | |
| 6,691,785 | B2 | 2/2004 | Patel | |
| 6,942,028 | B2 | 9/2005 | Hosie | |
| 7,909,103 | B2 * | 3/2011 | Fenton | 166/348 |
| 8,061,428 | B2 * | 11/2011 | Fenton et al. | 166/347 |
| 2006/0076141 | A1 | 4/2006 | Bartlett | |
| 2009/0211761 | A1 | 8/2009 | Broussard | |

FOREIGN PATENT DOCUMENTS

| | | | |
|---|---|---|---|
| GB | 2392683 A | * | 3/2004 |
| WO | 2004022908 A1 | | 3/2004 |

OTHER PUBLICATIONS

International Search Report and Written Opinion, PCT/2009/058280, dated Dec. 28, 2009.

* cited by examiner

*Primary Examiner* — Thomas Beach
*Assistant Examiner* — James Sayre
(74) *Attorney, Agent, or Firm* — Bracewell & Giuliani LLP

(57) ABSTRACT

A subsea wellhead assembly provided over a wellbore, the assembly having a wellhead housing, a tubing hanger in the housing, a production tree on the wellhead housing above the tubing hanger, and a control circuit that passes axially downward from the production tree and through the tubing hanger. A tree stab assembly may be included that is set between the tubing hanger and production tree. The wellhead assembly can also include a casing hanger landed in the housing, casing attached to the casing hanger, and tubing attached to the tubing hanger.

14 Claims, 6 Drawing Sheets

92
20
85
72
74
44
76
42
14
80
36
78
54
52
82
40
94
38
46
50
12
55
48
70
56
18
68
24
10
30
84
43
22
62
60
58
$A_x$

COMBINED TREE STAB AND CONTROL INTERFACE

CROSS REFERENCE TO RELATED APPLICATIONS

This application claims priority to and the benefit of co-pending U.S. Provisional Application Ser. No. 61/100,549, filed Sep. 26, 2008, the full disclosure of which is hereby incorporated by reference herein.

FIELD OF THE INVENTION

The present disclosure relates in general to production of oil and gas wells, and in particular to a wellhead assembly having a tree stab member comprising an isolation tube extending from a production tree to a tubing hanger. The tree stab member also includes a body circumscribing the isolation tube, the body includes a control line passage therethrough coupled with a hydraulic coupler.

DESCRIPTION OF RELATED ART

Systems for producing oil and gas from subsea wellbores typically include a subsea wellhead assembly having a wellhead housing at a wellbore opening, where the wellbore extends through one or more hydrocarbon producing formations. Subsea well assemblies generally include an outer or low pressure wellhead housing from which a string of conductor pipe descends downward into the well. An inner or high pressure wellhead housing is coaxially landed and set within the outer wellhead housing. The inner wellhead housing can support one or more casing hangers and attached strings of casing inserted into the well.

Pressure or fluid is communicated downhole through hydraulic lines for control and/or actuation of wellbore components. Example components being hydraulically actuated or controlled include safety valves, control valves, sliding sleeves, packers, etc. These components are generally disposed within the wellbore in an annulus between coaxial tubulars. Since it is impractical to pass the lines laterally through the tubulars to access the annulus, the lines enter the annulus at the wellhead. Space limitations in wellheads, especially subsea wellheads, often require that the hydraulic lines be routed axially through components in the wellhead assembly then into the wellbore.

SUMMARY OF THE INVENTION

Disclosed herein is an embodiment of a subsea wellhead assembly disposed over a wellbore having a stab member extending between a production tree and tubing hanger. A control line passage with a selectively openable coupler is provided in the stab member for providing fluid communication between control line passages in the production tree and tubing hanger. In one example embodiment disclosed herein a wellhead assembly includes a tubular wellhead member, a production tree that lands on the tubular wellhead member, a tubing hanger landed in the tubular wellhead member, a control line passage in the production tree, a control line passage in the tubing hanger, a stab member at least partially circumscribed by the tubular wellhead member that extends between the production tree and tubing hanger, a control line passage in the body in fluid communication with the production tree control line passage and in selective fluid communication with the tubing hanger control line passage. The wellhead assembly can include a circular channel on the stab member lower surface having an outer wall profiled to correspond to a surface on the upward facing surface on the tubing hanger upper end, so that when the production tree is on the wellhead housing a surface on the tubing hanger upper terminal end contacts the channel outer wall to form an interface surface. A controllable device may be included with the assembly that is within the wellbore and coupled to the end of the tubing hanger control passage opposite the tubing hanger upper terminal end, so that when pressurized fluid communicates to the controllable device through the control passage the device is operable. The tubing hanger upper terminal end may have a profiled surface on its outer radial periphery that faces away from the wellhead assembly axis to define an upward facing surface. The upward facing surface can be substantially in a plane generally perpendicular to the wellhead assembly axis.

Also described herein is a subsea wellhead assembly that includes a tubular wellhead member, a production tree on the wellhead member upper end, an annular casing hanger landed within the wellhead member, an annular tubing hanger landed at least within a portion of the casing hanger, a tree stab assembly having a lower side that engages the tubing hanger upper end and an upper side that engages the production tree lower end, a control line passage in the tubing hanger having an open upper end that exits the tubing hanger on an upper portion of the tubing hanger, and a control line passage in the tree stab assembly registerable and in selective fluid communication with the end of the tubing hanger control passage exiting on the tubing hanger upper portion.

DETAILED DESCRIPTION OF THE INVENTION

Figure 1:
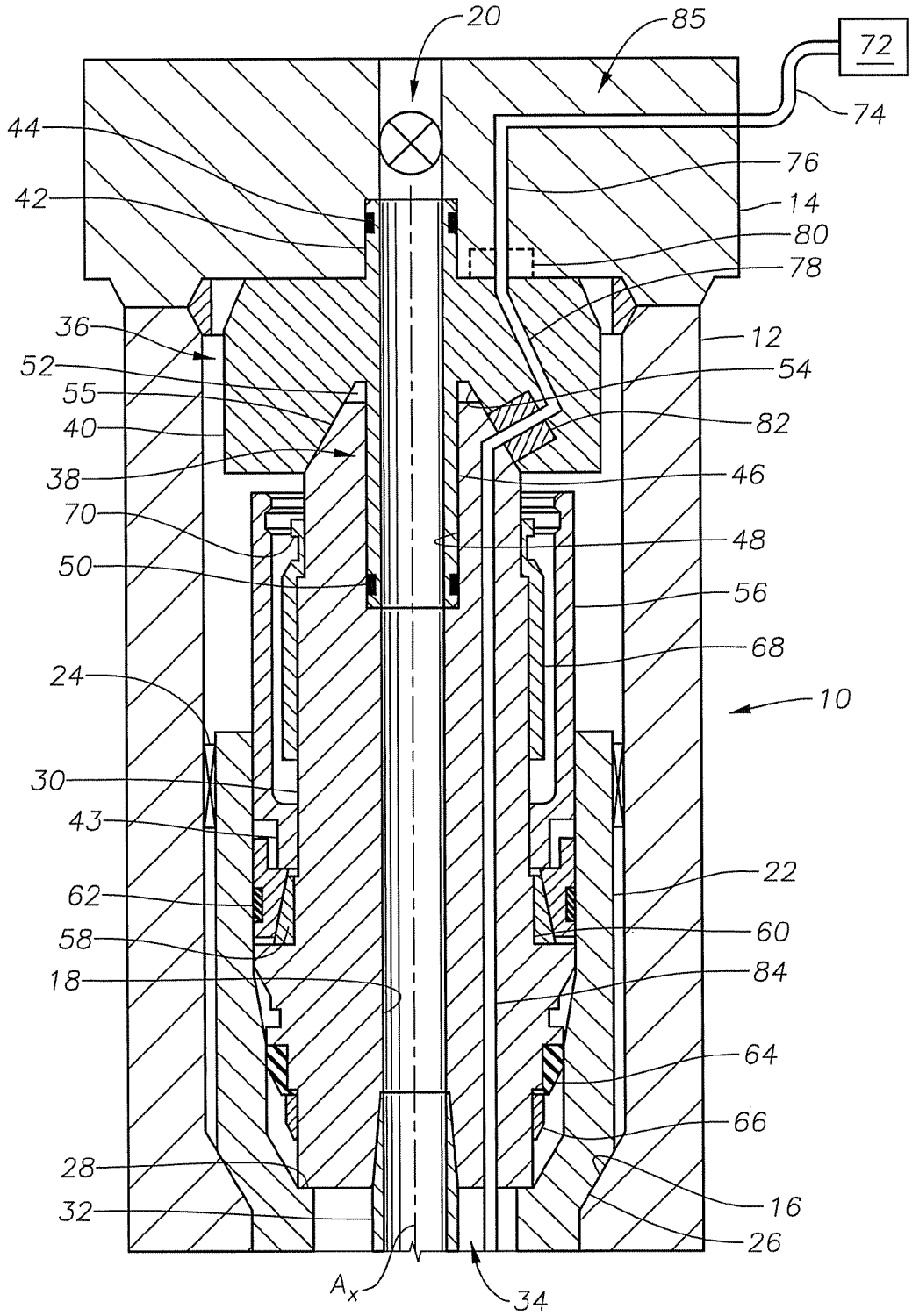
FIG. 1 is a schematic sectional view of a wellhead assembly constructed in accordance with an embodiment of the present disclosure.

The apparatus and method of the present disclosure will now be described more fully hereinafter with reference to the accompanying drawings in which embodiments are shown. This subject of the present disclosure may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional tetras such as "upper", "lower", "above", "below", and the like are being used to illustrate a relational location.

It is to be understood that the subject of the present disclosure is not limited to the exact details of construction, operation, exact materials, or embodiments shown and described, as modifications and equivalents will be apparent to one skilled in the art. In the drawings and specification, there have been disclosed illustrative embodiments of the subject disclosure and, although specific terms are employed, they are used in a generic and descriptive sense only and not for the purpose of limitation. Accordingly, the subject disclosure is therefore to be limited only by the scope of the appended claims.

FIG. 1 provides a side schematic view of an example of a wellhead assembly 10 in accordance with the present disclosure. The wellhead assembly 10 as shown includes an annular high pressure housing 12 and a production tree 14 is mounted on its upper end. The high pressure housing 12 inner diameter transitions obliquely radially towards the assembly axis $A_X$ to define a landing shoulder 16. A production bore 18 axially extends through the wellhead assembly 10 and the production tree 14. A production valve 20 is illustrated disposed in the bore 18 proximate where the bore 18 exits the production tree 14.

An annular casing hanger 22 is shown landed within the lower portion of the high pressure housing 12. An annular packoff 24 is set between the casing hanger 22 outer surface and high pressure housing 12 to form a seal between these two members. The casing hanger 22 outer surface angles radially inward defining a landing profile 26 shown landed on and supported by the landing shoulder 16. A radial ledge 28 is shown formed on the casing hanger 22 inner surface where it is profiled radially inward. An elongated annular tubing hanger 30 is shown disposed in the wellhead assembly 10 having its lower end supported on the radial ledge which also might be profiled radial inward 28. Tubing 32 is shown threadingly engaged with the lower end of the tubing hanger 30. A tubing annulus 34 is foamed between the tubing 32 and casing hanger 22.

A tree stab member 36 is shown coaxial with the production tree 14. The tree stab member 36 includes an isolation tube 38 and a substantially solid body portion 40 shown circumscribing the isolation tube 38. The isolation tube 38 defines at least a portion of the production bore 18 outer surface. The body portion 40, shown profiled similar to a toroid, includes a planar upper surface in contact with a portion of the production tree 14 lower surface. The isolation tube 38 has an upper portion 42 that protrudes from the body portion 40 upper surface into the production tree 14. A seal 44 may be included on the outer circumference of the upper portion 42 mating with the production tree 14. The stab member 36 may be attached to the production tree 14, for example by corresponding threads (not shown) provided on the upper portion 42 and bore 18. Optionally, the stab member 36 can be mounted onto the production tree 14 lower surface by fasteners and/or a weld. In yet another alternative, the production tree 14 and tree stab 36 can be a single modular unit.

The isolation tube 38 further includes a lower portion 46 that depends downward from the body portion 40 lower surface to within the tubing hanger 30. The lower portion 46 is inserted within an optional enlarged bore section 48 that is shown projecting along a portion of the tubing hanger 30 annulus. The lower portion 46 fills the enlarged bore section 48 thereby forming seamless surface along the production bore 18. A seal 50 may be included between the lower portion 46 outer circumference and enlarged bore section 48. An annular channel 52 projects into the body portion 40 from its lower surface along the lower portion 46 outer periphery. The channel 52 inner wall is generally parallel with the bore axis $A_X$ adjacent the lower portion 46; its outer wall 54 angles obliquely away from the bore axis $A_X$. The tubing hanger 30 upper end protrudes into a substantial portion of the channel 52. A chamfered surface 55 is shown on the tubing hanger 30 upper end along its outer surface that corresponds to the outer wall 54 angle. An interface surface is formed by contacting the chamfered surface 55 with outer wall 54.

An example of a lock down ring 56 is shown that coaxially circumscribes the tubing hanger 30 on its outer circumference. The lock down ring 56 illustrated is a sleeve like member having a wedge shaped dog 58 on its lower end. The dog's 58 width increases with distance away from its lower tip. Guides 60 are shown provided adjacent the dog 58 having an increasing width downward away from their upper tips. Thus downwardly urging the lockdown ring 56 forces the corresponding wider portions of the dog 58 and guides 60 into a coaxial arrangement and wedging or inserting into a mating groove the dog 58 and guides 60 between the casing hanger 22 and tubing hanger 30 and locking them together in another configuration the tubing hanger might be locked and sealed into the wellhead housing. A running tool (not shown) may be employed to provide the downward force onto the lock down ring 56. The guides 60 may optionally include seals 62 shown sealingly engaging the casing hanger 22 inner surface. Another seal 64 is shown on the tubing hanger 30 outer surface that engages the casing hanger 14 inner circumference. A seal retainer 66 is provided for axially supporting the seal 64. A retrieval sleeve 68 is provided coaxially between the lockdown ring 56 and tubing hanger 30 and attached to the tubing hanger 30. The retrieval sleeve 68 includes an upper lip 70 for attachment by the running tool to remove the tubing hanger 30.

A fluid supply 72 is schematically illustrated shown providing control or actuation fluid to the production tree 14 through a connected a supply line 74. The fluid supply 72 can be proximate or remote to the wellhead assembly 10 and can include a fluid reservoir and pressurizing device, such as a pump, for pressurizing and delivering fluid to the wellhead assembly 10. The fluid can be any liquid, such as hydraulic fluid as well as a gas, such as pressurized air or nitrogen. At the production tree 14, the supply line 74 couples to a control line passage 76 provided within the production tree 14 that conveys the fluid through the production tree 14. Optionally, a service control module (not shown) can be included at the production tree 14 outer surface for coupling the control line passage 76 and supply line 74. The control line passage 76 can be a passage bored through the tree 14, or a line inserted through a bore in the tree. A control line passage 78 is also provided within the body 40 shown registering with the control line passage 76. Although shown as a single control line passage 76, 34, the tree 14 and body 40 could each include multiple control line passages 76, 34. An optional manifold 80 may be included within the tree 14, body 40, or both for directing flow from a single control line passage 76 in the tree 14 to multiple control line passages 34 in the body 40.

In the example of FIG. 1, the control line passage 78 connects to a hydraulic coupler 82 provided within the body 40. The hydraulic coupler 82 registers with a control line passage 84 shown axially formed in the tubing hanger 30 body from the chamfered surface 55 and exiting into the tubing annulus 34. If the body 40 includes multiple control line passages 34, multiple hydraulic couplers 36 may be included. One example of a hydraulic coupler 82 considered for use herein can be found in McConaughy et al., U.S. Pat. No. 5,465,794, issued Nov. 14, 1995 and assigned to the assignee of the present application and Gariepy, U.S. Pat. No. 5,865,250, issued Feb. 2, 1999 and also assigned to the assignee of the present application. McConaughy et al. '794 and Gariepy '250 are incorporated by reference herein in their entireties. Fluid selectively flows through the end of the hydraulic coupler 82 opposite its end attached to the control line passage 78. In an embodiment, it includes a spring loaded seal that is disengaged when contacted to allow flow therethrough. In the example of FIG. 1, the sealable side of the hydraulic coupler 82 is positioned along the outer wall 54 of the body 40. Thus landing the stab member 36 onto the tubing hanger 30 and forming the interface surface between the chamfered surface 55 and outer wall 54, unseats the seal within the coupler 82 enabling fluid flow through the coupler 82 and into the control line passage 84. Optional alignment means (not shown) can be provided for orienting the production tree 14 such that when landed on the wellhead assembly 10, the hydraulic couplers 36 align to register with the control line passages 52 in the tubing hanger 40. The hydraulic couplers 36 may include a mating half located on the top of the control line passages 52. The combination of the fluid supply 72, lines 31, 17, 34, 52, and hydraulic coupler 82 form a control circuit 85.

Figure 2:
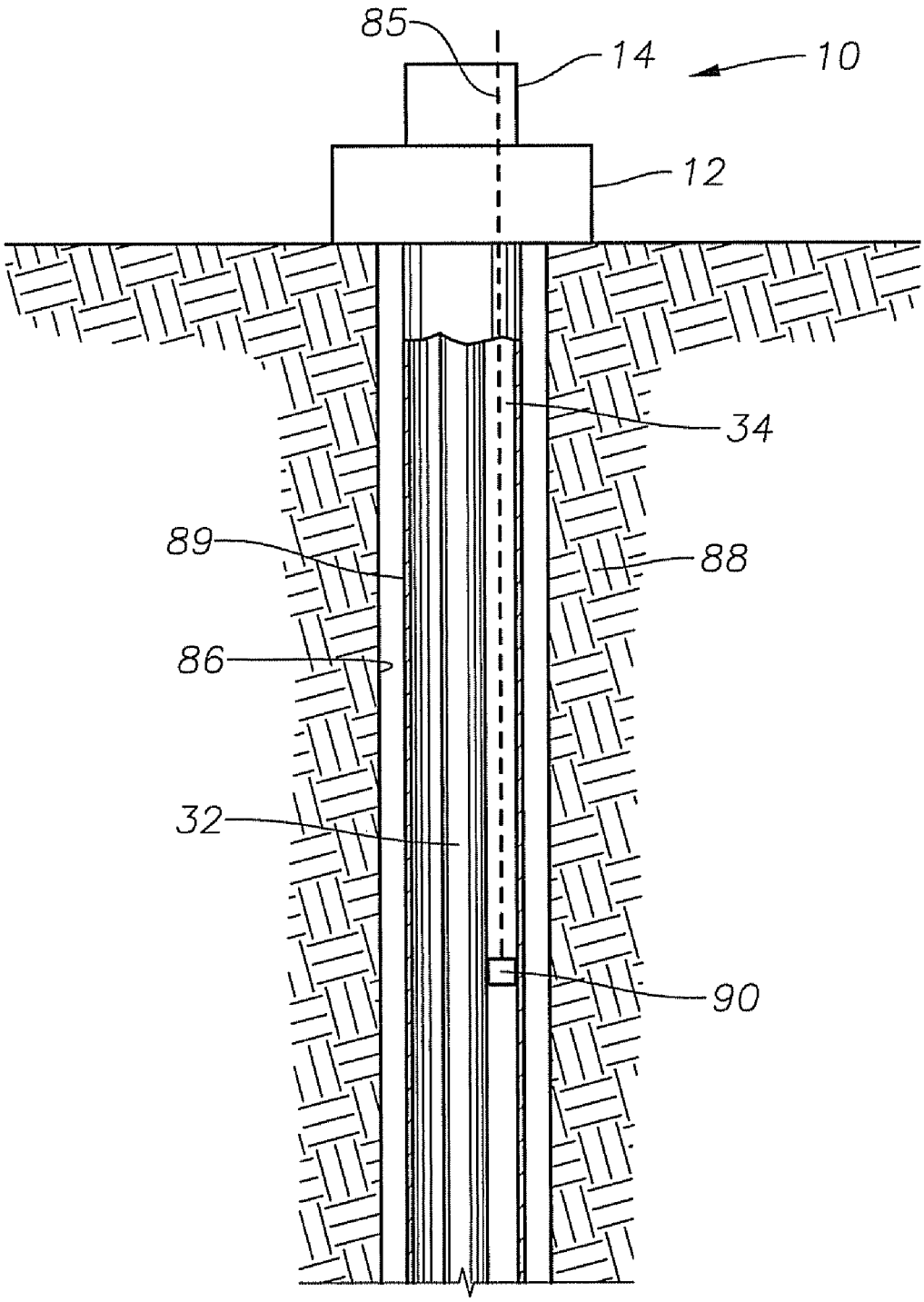
FIG. 2 is a schematic of a partial sectional view of a wellhead assembly over a wellbore having a controllable device within the wellbore.

An example of the wellhead assembly 10 is shown in a side partial sectional view in FIG. 2. As shown, the wellhead assembly 10 is mounted over a wellbore 86 bored through a formation 88. The control circuit 85 (shown as a dashed line) passes through the production tree 14, within the wellhead housing 12, and into the tubing annulus 34 between the tubing 32 and casing 89. However, other embodiments exist where the control circuit 85 is provided within any annulus or tubular associated with the wellhead assembly 10. A controllable device 90 is schematically illustrated within the tubing annulus 34, where the device 90 can be a safety valve, control valve, packer, sliding sleeve, or other device controlled and/or actuated by connection with the control circuit 85. In an example of use, the device 90 is controlled and/or actuated by flowing pressurized fluid through the control circuit 85 to the device 90.

Figure 3:
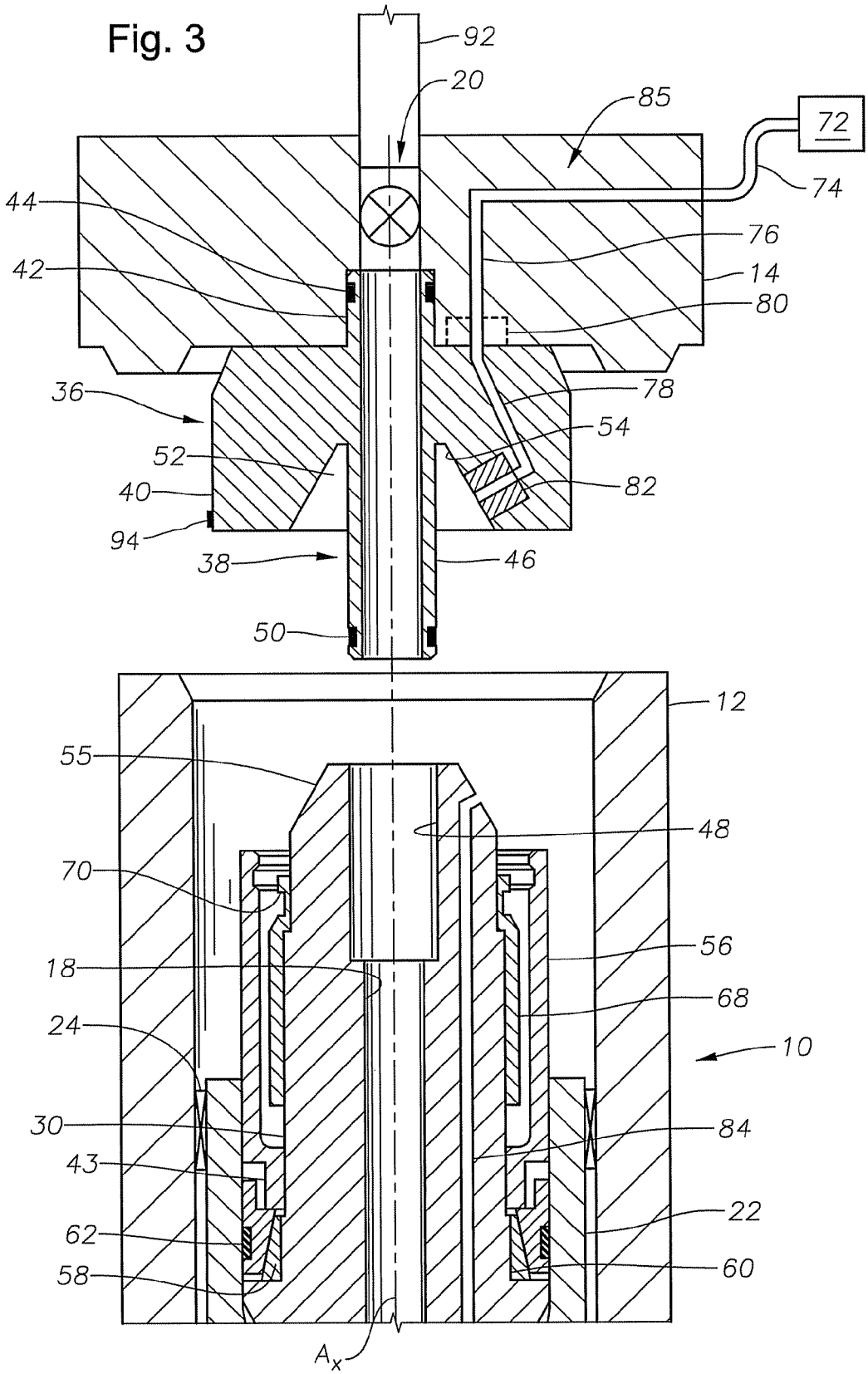
FIG. 3 is an illustration of an example of the wellhead assembly of FIG. 1 being assembled or disassembled.
Figure 3A:
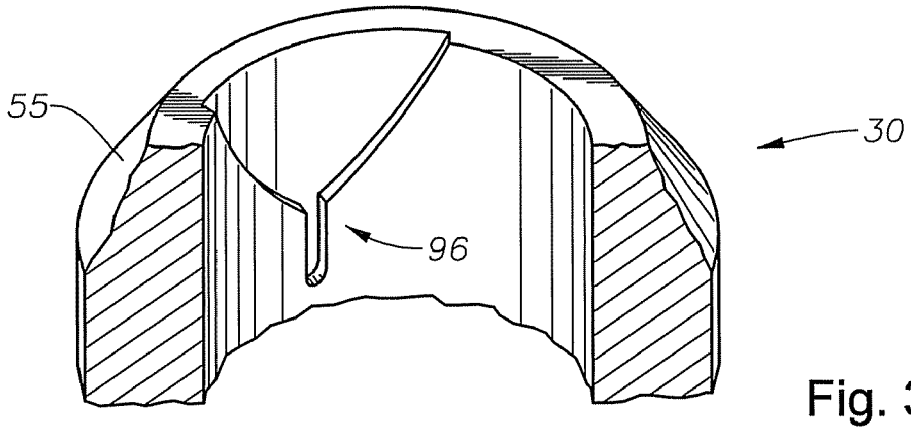
FIG. 3A is a side perspective view of an example of an orienting device.

FIG. 3 illustrates an example of a step of assembling a wellhead assembly 10 embodiment. In this example, the wellhead housing 12 is anchored over the wellbore and the casing hanger 22 and tubing hanger 30 are landed within the housing 12. The production tree 14 and attached tree stab member 36 are shown suspended from a running tool 92 and being lowered onto the housing 12 and tubing hanger 30. The hydraulic coupler 82 includes an outer surface that is substantially flush with the outer wall 54 and in a sealed configuration. An optional orientation tab 94 is shown on the body 40 outer surface that can engage a muleshoe type recess 96 shown at the upper portion of the enlarged bore 48 within the tubing hanger 30. The recess 96 is illustrated in a side view in FIG. 3A shown having an enlarged opening and inwardly converging side walls defining a narrow width at its lower end. As the stab member 36 lands in the tubing hanger 30, the tab 94 will eventually contact a recess 96 side wall and slide along the wall to the recess 96 bottom. As the tab 94 is azimuthally redirected as it slides along the side wall to rotate the body 40 and tree 14. Strategically positioning the recess 96 bottom properly orients the tree 14 and body 40 to register the hydraulic coupler 82 and control line passage 84.

Figure 4:
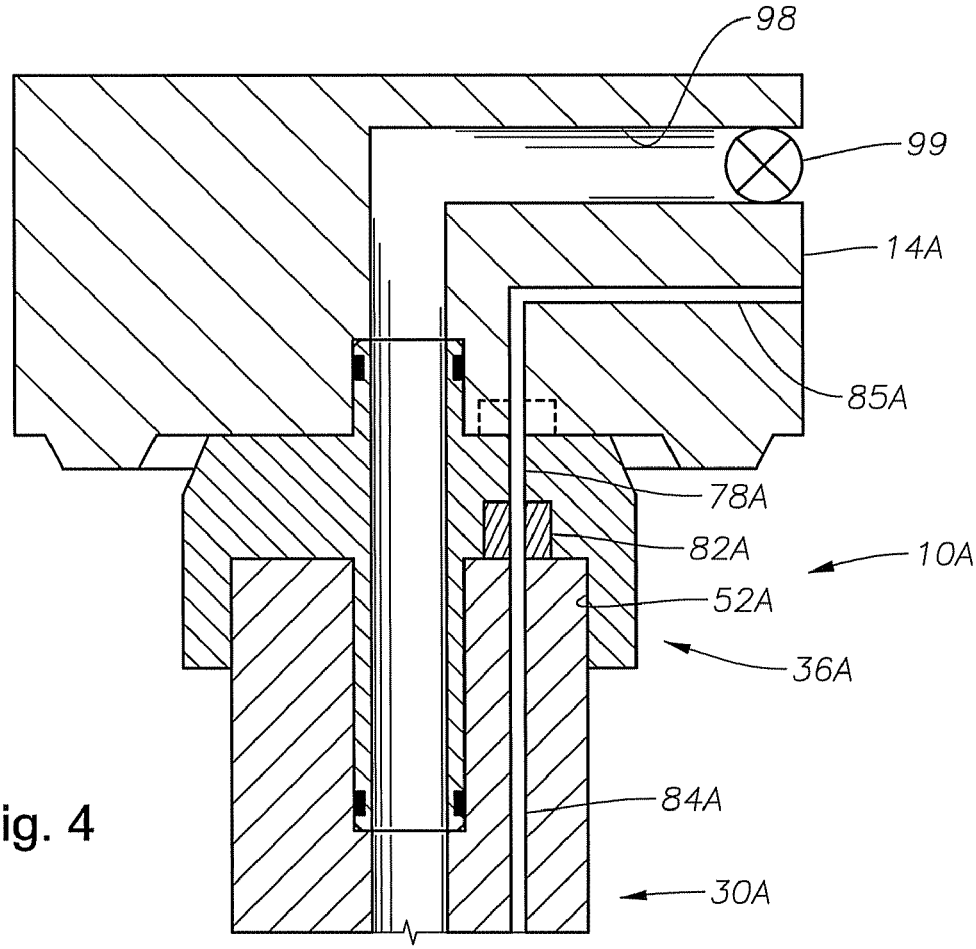
FIG. 4 is a depiction of an alternative embodiment of a wellhead assembly.

An alternative embodiment of a wellhead assembly 10A is provided in a side partial sectional view in FIG. 4. In this example the hydraulic coupler 82A is set within the channel 52A upper surface. Accordingly, the control line passage 84A has an end on the tubing hanger 30A upper surface for registering with the hydraulic coupler 82A. The wellhead assembly 10A embodiment of FIG. 4 further includes a production line 98 shown passing laterally through the production tree 14A with a corresponding wing valve 99 for selectively controlling flow through the production line 98.

Figure 5:
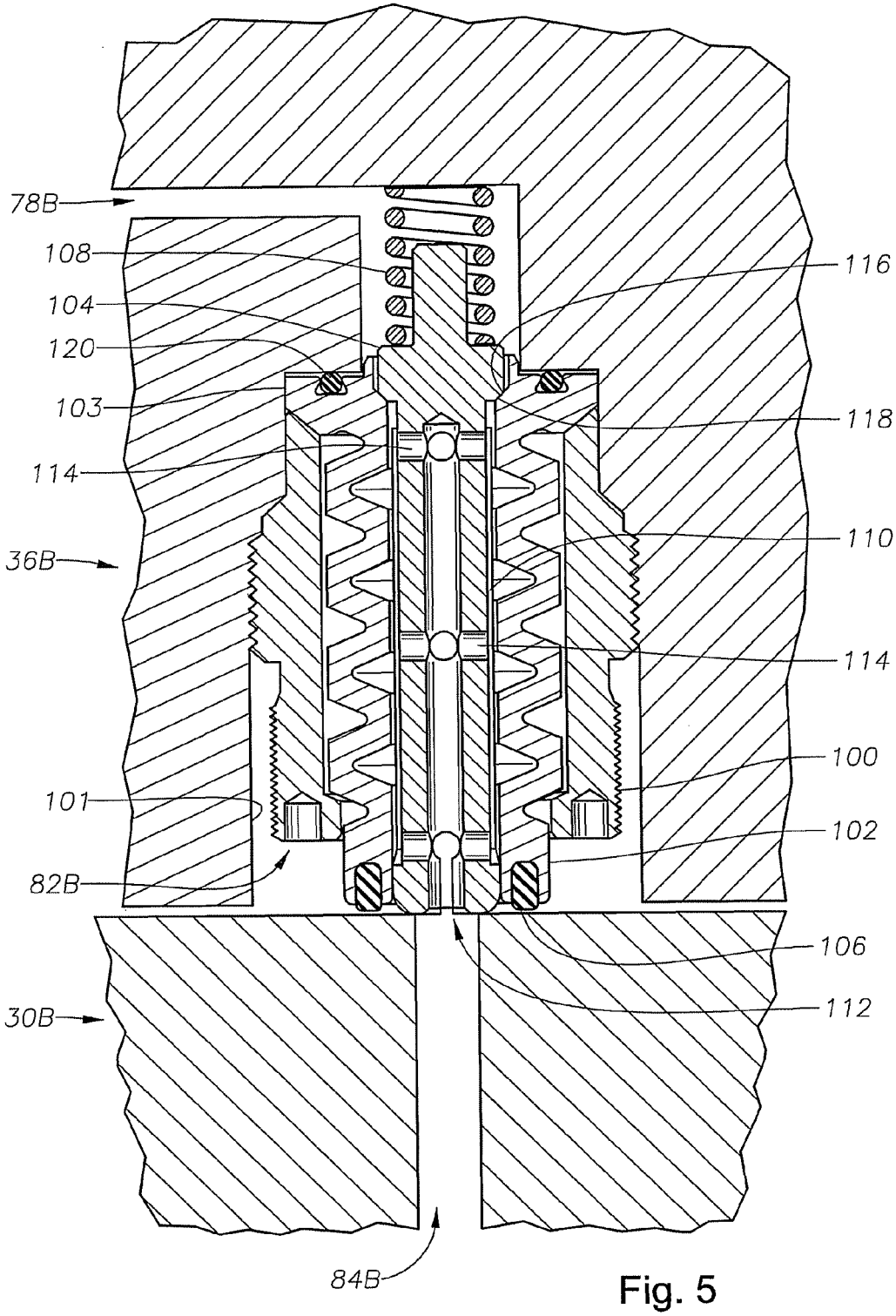
FIG. 5 is an illustration of an example of a hydraulic coupler within a wellhead assembly.

FIG. 5 illustrates in a side sectional view details of an example of a hydraulic coupler 82B in the stab member 36B prior to being landed onto the tubing hanger 30B. In this embodiment the hydraulic coupler 82B includes a generally annular body 100 threadingly secured within a cavity 101 formed in the stab member 36B. The control line passage 78B is shown terminating at the cavity 101 lower end. A seal tube 102 is shown coaxially disposed within the body 100 having a lip 103 protruding radially outwardly from its end proximate the cavity 101 bottom. A portion of the lip 103 is wedged in the axial space between the body 100 and cavity 101 bottom, thus securing the seal tube 102 within the cavity 101. In the embodiment shown, the seal tube 102 walls are corrugated thereby resembling a bellows like member.

An elongate check valve 104 is shown coaxially disposed in the seal tube 102, both the forward and aft ends of the check valve 104 extend past the seal tube 102 ends. A seal 106 is partially embedded on the tube 102 end opposite the lip 103. When the stab member 36B is fully landed onto the tubing hanger 30B, the seal 106 contacts the tubing hanger 30B upper surface. Upon contact, the seal 106 may be compressed to form a sealing surface that circumscribes where the control line passage 84B exits the tubing hanger 30B. An annular space 110 is shown formed between the check valve 104 and seal tube 102. A flow passage 112 is shown bored within the check valve 104 along a portion of its length, the flow passage 112 opening from the check valve 104 is shown facing the control line passage 84B. Lateral passages 114 are formed in the check valve 104 between the flow passage 112 and the annular space 110.

A spring 108 within the cavity 101 outwardly biases the check valve 104 so that a radial seat 116 on the check valve 104 sealingly contacts a seal surface 118 on the tube 102 inner surface adjacent the lip 103. The check valve 104 end adjacent the seal 106 also contacts the tubing hanger 30B when the stab member 36B is landed. The tubing hanger 30B contact overcomes the spring 108 biasing force to urge the check valve 104 inside the cavity 101 thereby moving the seat 116 away from the sealing surface 118. Separating the seat 116 and sealing surface 118 opens fluid communication between the annular space 110 and control line passage 78B, thereby providing a fluid path through the hydraulic coupling 82B and between control line passages 84B, 78B. A seal 120 is shown provided on the lip 103 surface facing the cavity 101 bottom that blocks flow communication between the body 100 outer surface and cavity 101.

Figure 6:
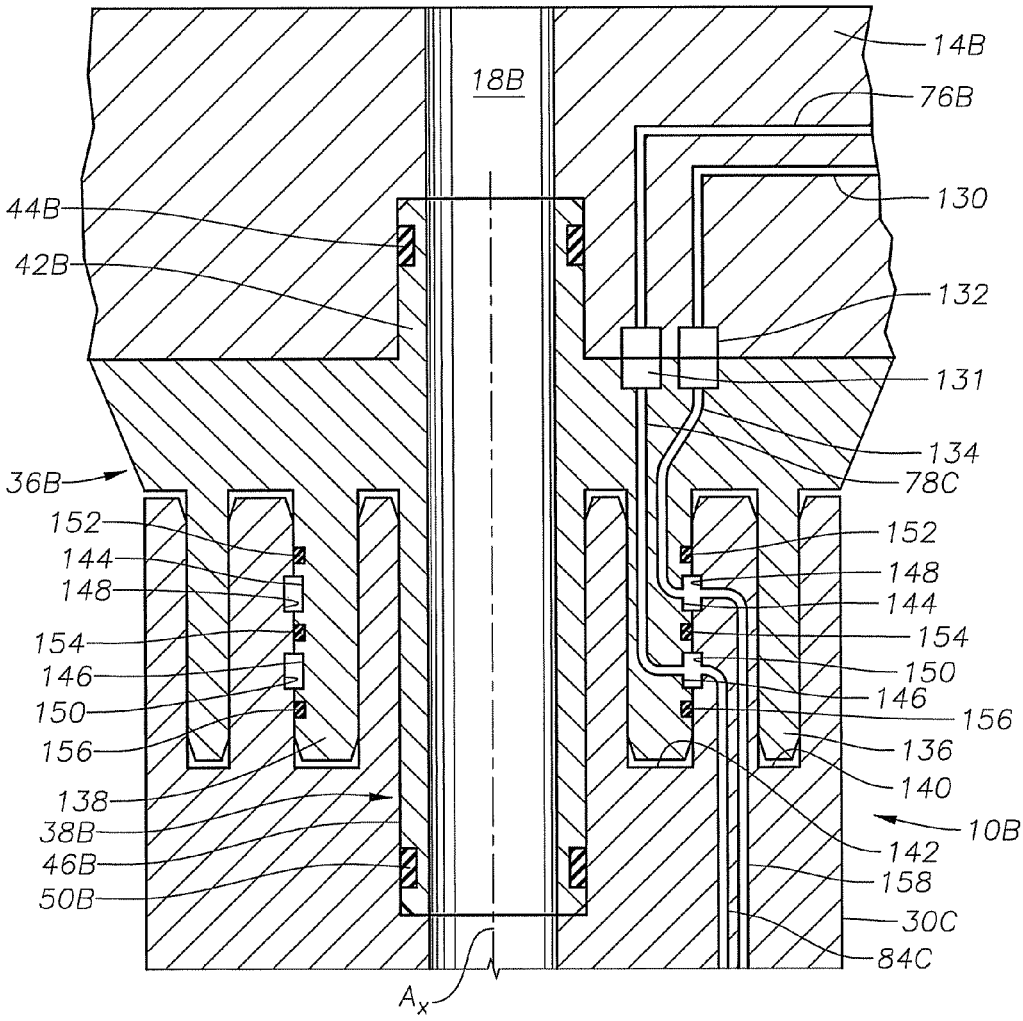
FIG. 6 is a example of an alternative embodiment of a wellhead assembly.

Another alternative example of a wellhead assembly 10B is schematically illustrated in a side sectional view in FIG. 6. In this example, control line passage 76B shown routing through the production tree 14B is joined by another control line passage 130. The control line passages 76B, 130 end respectively at connectors 131, 132 that span the interface between the production tree 14B and stab member 36B. The connectors 131, 132 can be cylindrical members with their opposing ends projecting both into the tree 14B and stab member 36B. A bore (not shown) axially formed through the connectors 131, 132 communicates fluid, or is a pathway, from the control line passages 76B, 130 to control line passages 78C, 134 shown coursing within the stab member 36B. Concentric rings 136, 138, circumscribing the bore axis $A_X$, project from the lower surface of the stab member 36B into concentric channels 140, 142 formed into the upper surface of the of the tubing hanger 30C. The stab member 36B includes an isolation tube 38B having a tubular inner surface that defines a portion of the production bore 18B. An upper portion 42B of the isolation tube 38B projects partially within the production tree 14B that includes a seal 44B between it and the production tree 14B. A lower portion 46B of the stab member 36B projects downward within a portion of a tubing hanger 30C and having a seal 50B between it and the tubing hanger 30C.

Grooves 144, 146 are illustrated formed into the outer circumference of the ring 138. The grooves 144, 146 register with corresponding grooves 148, 150 shown in the outer wall of the channel 142. The interface between the outer circumference of the ring 138 and outer circumference of the channel 142 is sealed above the registered grooves 144, 148 and 146, 150 with circular seal 152. The space between the registered grooves 144, 148 and 146, 150 is sealed with seal 154; and the below the registered grooves 144, 148 and 146, 150 is sealed with seal 156. A control line passage 84C connects to the groove 146 on a side opposite where the groove 146 registers with groove 150 and a control line passage 158 connects to the groove 144 on a side opposite where the groove 144 registers with groove 148. The grooves 144, 146, 148, 150 form a gallery like configuration that provides communication between control line passages 78C, 134 and control line passages 84C, 158. Communication between the control line passages 78C, 134 and control line passages 84C, 158 is established when the stab member 36B lands onto the tubing hanger 30C irrespective of their respective azimuthal orientations. The communication can be fluid communication or a pathway for signaling means, such as fiber optics, wire, as well as pneumatic or other type of fluid lines for signal communication. FIG. 6 shows multiple concentric channels each of which can contain one or more control circuits.

One of the advantages of the present device is the ability to provide hydraulic control line passages through a wellhead assembly especially when dealing with slim completions and smart wells. Properly orienting the production tree 14 can be performed with conventional means. While the invention has been shown in only one of its forms, it should be apparent to those skilled in the art that it is not so limited, but is susceptible to various changes without departing from the scope of the invention. For example, a wellhead assembly 10 could include a tubing spool (not shown) inserted between the production tree 14 and wellhead housing 12 as well as concentric and/or stacked sealed galleries. The tubing spool can be substantially coaxial with the wellhead housing 12 with the tubing hanger 30 landed in the spool.

What is claimed is:

1. A subsea wellhead assembly disposed over a wellbore comprising:

a tubular wellhead member;

a production tree that lands on the tubular wellhead member having an axial bore;

a tubing hanger landed in the tubular wellhead member and having an axial bore;

a control line passage in the production tree;

a control line passage in the tubing hanger;

a stab member between the production tree and tubing hanger that comprises an annular upper portion extending into the axial bore in the production tree, an annular isolation tube extending into the axial bore in the tubing hanger, and a body that projects radially outward past the tubing hanger; and a control line passage in the stab member in fluid communication with the production tree control line passage and in selective fluid communication with the tubing hanger control line passage.

2. The wellhead assembly of claim 1, further comprising a channel that circumscribes a portion or the isolation tube and has an outer wall profiled oblique to an axis of the stab member and complementary to an upward facing surface on the tubing hanger, so that when the production tree is on the wellhead member, the upward facing surface on the tubing hanger contacts the outer wall to define an interface surface, wherein the control line passage in the stab member registers with the control line passage in the tubing hanger along the interface surface.

3. The wellhead assembly of claim 2, further comprising a hydraulic coupler in the stab member having a selectively sealable end facing the outer wall.

4. The wellhead assembly of claim 1, further comprising a controllable device within the wellbore coupled to the end of the tubing hanger control line passage opposite the tubing hanger upper terminal end, so that when pressurized fluid communicates to the controllable device through the control line passage the device is operable.

5. The wellhead assembly of claim 1, wherein a surface on the tubing hanger upper terminal end is profiled on its outer radial periphery to form a surface facing away from the wellhead assembly axis to define an upward facing surface.

6. The wellhead assembly of claim 5, wherein the upward facing surface lies substantially in a plane generally perpendicular to the wellhead assembly axis.

7. The wellhead assembly of claim 1, further comprising an annular casing hanger landed in the wellhead member, casing depending downward from the casing hanger, a radial ledge provided on the casing hanger inner circumference having the tubing hanger landed thereon, tubing depending downward from the tubing hanger, a tubing annulus between the tubing and casing, and an axial bore extending through the production tree, tubing hanger, and tubing.

8. A subsea wellhead assembly comprising:

a tubular wellhead member;

a production tree on the wellhead member upper end;

an annular casing hanger landed within the wellhead member;

an annular tubing hanger landed at least within a portion of the casing hanger;

a tree stab assembly between the tubing hanger and production tree that comprises a body, a bore through the body in fluid communication with the production tree and tubing hanger, and a channel circumscribing the bore in the body that has a surface in contact with an outer radial surface of the tubing hanger;

a control line passage that extends through the tubing hanger, into the tree stab assembly where the surface of the body is in contact with the outer radial surface of the tubing hanger, and into the production tree.

9. The wellhead assembly of claim 8, wherein the tree stab further comprises an annular upper portion that inserts into the production tree, an isolation tube that inserts into the tubing hanger, a sealing device for sealing an interlace where the control line passage crosses between the tree stab and the tubing hanger, and an orientation device for registering respective portions of the control line passage in the tree stab and the tubing hanger.

10. The wellhead assembly of claim 8, further comprising an annular isolation tube having a portion coaxially extending from the tree stab assembly into an axial bore in the production tree and another portion coaxially extending from the tree stab in an opposite direction coaxially into the tubing hanger.

11. The wellhead assembly of claim 8, further comprising a hydraulic coupler in the tree stab assembly having an end connected to the tree stab assembly control line passage and an opposite end registerable and in selective fluid communication with the tubing hanger control line passage.

12. The wellhead assembly of claim 8, further comprising a control line passage in the production tree connected to the tree stab control line passage.

13. The wellhead assembly of claim 12, further comprising a fluid supply connected to the production tree control line passage.

14. The wellhead assembly of claim 8, further comprising a circular channel on the surface of the tree stab assembly facing the tubing hanger generally coaxial with the tubing hanger upper end and having an outer wall angling radially outward, wherein the upper end of the tubing hanger is beveled on its outer periphery to correspond to the channel outer wall, so that when the tubing hanger upper and is inserted into the channel, the outer wall and beveled outer periphery contact to form an interface surface across which the tubing hanger and tree stab control line passages register.

* * * * *